US005153104A

United States Patent [19]

Rossman et al.

[11] Patent Number: 5,153,104

[45] Date of Patent: Oct. 6, 1992

[54] THERMALLY DEVELOPABLE LIGHT-SENSITIVE LAYERS CONTAINING PHOTOBLEACHABLE SENSITIZERS

[75] Inventors: Mitchell A. Rossman, Minneapolis; Frank T. Sher, St. Paul, both of Minn.

[73] Assignee: Minnesota Mining and Manufacturing Company, St. Paul, Minn.

[21] Appl. No.: 754,169

[22] Filed: Sep. 3, 1992

Related U.S. Application Data

[63] Continuation of Ser. No. 539,565, Jun. 18, 1990, abandoned.

[51] Int. Cl.[5] ..... G03C 5/24; G03C 1/52

[52] U.S. Cl. ..... 430/339; 430/336; 430/340; 430/344; 430/920

[58] Field of Search ..... 430/339, 336, 340, 344, 430/920; 428/913

[56] References Cited

U.S. PATENT DOCUMENTS

| | | | |
|---|---|---|---|
| 3,647,433 | 3/1972 | Controis | 96/1.6 |
| 3,988,156 | 10/1976 | Sturmer | 430/522 |
| 4,271,263 | 6/1981 | Goettert | 430/513 |
| 4,370,401 | 1/1983 | Winslow et al. | 430/339 |
| 4,379,835 | 4/1983 | Lowrey et al. | 430/338 |
| 4,460,677 | 7/1984 | Smith et al. | 430/336 |
| 4,701,402 | 10/1987 | Patel et al. | 430/339 |

*Primary Examiner*—Charles L. Bowers, Jr.
*Assistant Examiner*—Thorl Chea
*Attorney, Agent, or Firm*—Gary L. Griswold; Walter N. Kirn; Mark A. Litman

[57] ABSTRACT

Negative-acting photothermographic imaging systems with improved color fidelity and light fastness are disclosed comprising a photobleachable sensitizer, a nitrate salt, an initiator, a leuco dye, a binder, and an optional organic acid. These systems may be used in a variety of applications comprising single or multiple layers in either single or multiple sheet constructions to provide color imaging elements.

20 Claims, No Drawings

THERMALLY DEVELOPABLE LIGHT-SENSITIVE LAYERS CONTAINING PHOTOBLEACHABLE SENSITIZERS

CROSS-REFERENCE TO RELATED CASES

This is a continuation of application Ser. No. 07/539,565 filed Jun. 18, 1990, now abandoned. Which is related to a commonly assigned application entitled "Light Sensitive Elements", U.S. Ser. No. 83,522 filed Aug. 7, 1987, continued as U.S. Ser. No. 394,250, filed Aug. 11, 1989.

BACKGROUND OF THE INVENTION

1. Field of the Invention

The present invention relates to visible light sensitive imaging systems, and in particular to photothermographic imaging systems comprising a nitrate salt, a leuco dye, an initiator, a sensitizing dye, a binder, and an optional organic acid.

2. Information Disclosure Statement

Many processes and compositions use leuco dyes to provide optical densities in the imaged article. For example, U.S. Pat. No. 4,017,313 uses a combination of a photosensitive leuco dye, a photosensitizer for the dye, an aromatic aldehyde and a secondary or tertiary amine. Other photosensitive systems using leuco dyes are included in U.S. Pat. Nos. 3,390,997, 2,884,326, and 2,772,284. The mechanism of these last two patents are disclosed in "Aromatic Aldehyde-Leuco Dye Photooxidation" (Hartzler, H. D. *Pure Appl. Chem.* 1977, 49, pp 353–356.)

*Light-Sensitive Systems* (Kosar, J.; John Wiley and Sons: New York, 1965: p 369), describes print-out photosensitive systems comprising a binder, leuco dye, organic halogen releasing compound and a photosensitizing dye. Because these are printout systems, there is no thermal amplification.

A great many photosensitive materials have been used in different imaging processes utilizing various photoinitiated phenomena such as photohardening of polymerizable materials (e.g., negative-acting printing plates), photosolubilizing materials (e.g., positive-acting printing plates), light initiated diazonium salt coupling reactions (e.g., diazonium microfilm), etc. A class of iodonium photoinitiators for both cationic and epoxy polymerization (e.g., U.S. Pat. Nos. 4,026,705 and 3,981,897) has also been proposed as equivalent to other photoinitiators in certain ethylenically unsaturated printing plate compositions (e.g., U.S. Pat. No. 3,741,769).

Photothermographic imaging systems are well known in the art. By definition photothermographic systems are light-sensitive imaging systems which are thermally developed. Photothermographic systems typically require temperatures in the range of 80° to 200° C. A number of imaging systems employ photosensitive compounds, leuco dyes or bleachable dyes, and nitrate salts to generate color images. Imaging systems comprising a leuco dye or bleachable dye, nitrate ion, and diazonium salts in a binder are disclosed in U.S. Pat. No. 4,370,401. In those cases wherein a leuco dye system is employed, a photothermographic, negative-acting imaging system is provided; that is, the optical density in the final image is more dense in areas which are light struck than in areas which are not light struck. Conversely, in those cases wherein a bleachable dye system is employed, a photothermographic, positive acting imaging system is provided. That is, the optical density in the final image is more dense in areas which are not light struck than in areas which are light struck. The bleachable dye used in these cases does not serve in the role of a sensitizer.

Related imaging compositions comprising a diazonium salt and leuco dye in a binder are disclosed in U.S. Pat. No. 4,394,433. These unamplified compositions are positive-acting photothermographic compositions, and differ fundamentally from the compositions of the present invention, which are amplified by the action of a nitrate salt.

Additional light-sensitive, thermally developable imaging systems are known. U.S. Pat. No. 4,460,677 describes a thermally developable imaging system comprising a leuco dye, nitrate ion, and a spectrally sensitized organic compound having photolyzable halogen atoms. Similarly, U.S. Pat. No. 4,386,154 describes a thermally developable imaging system comprising a leuco dye, a nitrate salt, and a spectrally sensitized compound selected from (1) aromatic iodonium salts and (2) photolyzable organic halogen compounds. Both of these compositions act as negative image forming systems in that the greatest image density is formed upon heat development in the light struck areas. The latent images are formed upon exposure to visible light and visible images are formed by heat development. The color fidelity and contrast of both of these systems is reduced by the presence of sensitizer stain, that is color due to the sensitizer which remains in the system, and to colored by-products from reacted sensitizer in light exposed regions. This sensitizer stain aesthetically and functionally detracts from the image.

Light-sensitive, thermally developable imaging systems are also described in several Japanese patents.

Japanese Pat. No. 77,025,330 pertains to a two component positive acting imaging composition comprised of an oxazine or phenothiazine leuco dye (BLMB) mono- or disubstituted with a dialkylamino group, and an oxidizing agent such as nitrate ion. Said composition is not light sensitive in the visible region of the spectrum, and does not employ diaryliodonium salts or organic compounds having photolyzable halogen atoms.

Japanese Pat. No. 77,004,180 describes the use of triplet sensitizers for BLMB. Suitable sensitizers are aromatic carbonyl compounds and aromatic nitro compounds. That patent describes both negative and positive systems, and is a counterpart to Japanese Pat. No. 77,025,330. Said composition is not light sensitive in the visible region of the spectrum, and does not employ diaryliodonium salts or organic compounds having photolyzable halogen atoms. Further, triplet sensitizers are by definition not photobleached during energy transfer.

Japanese Pat. No. 76,035,847 describes photosensitive heat-fixable recording materials containing a free radical producing organic halogen compound, leuco dye and a base. This is a negative-acting system, and contains no oxidizer.

Japanese Pat. No. 77,025,088 describes photosensitive compositions containing an acid-sensitive leuco dye (e.g., naphthospiropyran), and a photochemical acid generating agent which is a mixture of an organic halide (e.g., $CBr_4$), with a furan containing compound.

Japanese Pat. No. 79,001,453 describes a photothermographic material which contains an oxidizer, a compound which reacts with the oxidizer to change or develop color, and a compound which deactivates the color developer either in exposed or unexposed regions. Images can be either positive or negative, and do not employ sensitizers or diaryliodonium salts or organic compounds having photolyzable halogen atoms, which are components of the present invention, and which activate rather than deactivate color development. The light sensitive materials used were colorless or nearly colorless aryl quinones and ultraviolet light sources were used for imaging. Additionally, the light-sensitive materials used were not photobleachable. Furthermore, the compositions of the present invention show considerable amplification in both exposed and unexposed regions due to the presence of an added UV sensitive initiator (i.e., diaryliodonium salt or a organic compound with photolyzable halogen atoms), and therefore do not function by deactivation in the sense of Japanese Pat. No. 79,001,453.

Decolorizable imaging systems comprising a binder, nitrate salt, acid, and dyes are disclosed in U.S. Pat. Nos. 4,336,323 and 4,373,020. These systems are particularly useful as antihalation layers in photothermographic systems where the development temperature acts to bleach the dye.

The use of photobleachable dyes including o-nitroarylidene dyes as antihalation or acutance dyes is known in the art: U.S. Pat. Nos. 4,111,699; 4,271,263; 4,088,497; 4,033,948; 4,028,113; 3,988,156; 3,988,154; 3,984,248; 3,615,432 (RE28,225). The use of photobleachable dyes in this manner is unrelated to their function in the present invention. Additionally, it was found that o-nitroarylidene dyes are desensitizing to silver halide imaging systems.

Spectral sensitization of silver containing photothermographic compositions has been disclosed in U.S. Pat. No. 4,461,828; however, no mention is made of photobleachable sensitizers.

U.S. Pat. No. 4,713,312 teaches photobleachable sensitizers useful in the wavelength range of 390–500 nm for free radical polymerization to reduce background sensitizer stain in an imaging system based on photosensitive microcapsules. In the case of a full color imaging system, for which sensitivity to the entire visible spectrum of 400–700 nm is necessary, this patent does not provide for complete removal of residual sensitizer stain.

SUMMARY OF THE INVENTION

Photothermographic imaging layers of this invention comprise a nitrate salt, a leuco dye, an initiator, and a photobleachable sensitizer. The initiators useful for this invention include diaryliodonium salts and photolyzable organic halogen compounds. The photobleachable sensitizers of this invention include, but are not limited to o-nitroarylidene dyes such as 2,4-dinitrobenzylidene, 3,6-dinitropyridyl-2-idene, and 5-nitropyrimidyl-4-idene containing dyes, and are capable of sensitizing an initiator over the entire visible spectrum of 400–700 nm.

This invention describes layers comprised of a nitrate salt, a leuco dye, an initiator, and a photobleachable sensitizer. These layers are normally carried by a binder such as a polymeric binder which may also contain an organic acid.

The imaging layers of this invention have reduced residual sensitizer stain in both exposed regions of the layer, and following a post-development blanket irradiation, in unexposed regions as well. Following a post-development blanket irradiation, the imaging layers of this invention may optionally be fixed by treatment with a basic material to neutralize acid which is present in the layer.

This invention describes a photothermographic imaging layer which provides clean and stable images by overcoming the deficiencies of the prior art which are (1) undesirable residual sensitizer stain, and (2) relatively unstable images due to absorption of light and subsequent changes in color.

This invention is achieved by providing novel photothermographic imaging layers which comprise a leuco dye, nitrate salt, an initiator, and a photobleachable sensitizer (preferably an o-nitroarylidene) compound. These layers are preferably carried in a binder such as a polymeric binder, and preferably also contain an organic acid. After exposing the system to light, the application of heat develops the image by oxidizing the leuco dye more rapidly in the exposed region affording a negative-acting system. An image results because of the differential rate of oxidation occurring in exposed and unexposed regions. Latent images are formed upon exposure to visible light and stable images are then formed by heat development and blanket light exposure. Therefore, no wet processing steps are needed.

DETAILED DESCRIPTION OF THE INVENTION

Thermally developable imaging systems described in U.S. Pat. Nos. 4,460,677 and 4,386,154 comprise a leuco dye, nitrate ion, and either (1) a spectrally sensitized organic compound having photolyzable halogen atom; or (2) a spectrally sensitized diaryliodonium salt. Each of these systems has two disadvantages: (1) aesthetically undesirable residual sensitizer stain, and (2) relatively unstable images due to absorption of light causing subsequent changes in color. Accordingly, there is a need for the light-sensitive, thermally developable imaging layers of this invention which provide cleaner and more stable images.

There are a minimum of five components to the imaging systems of the present invention. The five required ingredients are (1) a photobleachable spectral sensitizing dye (spectral sensitizer), (2) a nitrate salt, (3) a leuco dye, (4) an initiator, and (5) polymeric resin (binder). An acidic material constitutes a preferred sixth ingredient.

PHOTOBLEACHABLE SENSITIZER

Any dye which is both a sensitizer for initiators of the present invention and which is also photobleachable is useful in the present invention. A particular class of dyes useful as photobleachable sensitizers of this invention is the class of o-nitro-substituted arylidene dyes comprising an o-nitro-substituted aryl group joined through a methine chain linkage, said methine chain having a minimum of 2 methine carbon atoms, to an electron donor; said donor comprising either (1) a basic heterocyclic nucleus containing an electron-donating atom, typically a nitrogen, oxygen, or sulfur electron-donating atom, or (2) an alkylamino group, or (3) a dialkylamino group. The number of atoms joining the basic heterocyclic nucleus and the aryl group can be an even or odd number. As employed herein the term "arylidene" refers to a group formed by an aryl group and a methine linkage (e.g., benzylidene, cinnamylidene, etc.)

The term photobleachable means that upon exposure to actinic radiation between about 350 nm and about 1100 nm the dye is converted to a colorless or nearly colorless form (i.e., the molar absorptivity is reduced by at least a factor of 5). Photobleachable sensitizers useful in the present invention bleach at least 10%, and preferably bleach at least 25% and more preferably at least 50% when exposed to the following conditions:

a film of polyethylene terephthalate (4 mil thickness) is coated with the sensitizer in question so as to create a colored film with an absorbance of from 0.1 to 0.6, whereupon said colored film is then placed onto the Fresnel lens of a 3M brand Model 213 Overhead Projector and exposed to light therefrom for 5 minutes.

The photobleachable sensitizers are said to bleach at a given percentage when the layer containing the sensitizer decreases absorbance (absorption intensity) by a given percentage at the longest wavelength absorption band maximum. This absorbance may be measured either by percentage reduction in optical density provided by the sensitizer or by measurement of the percentage of radiation actually absorbed.

The overhead projector uses a single General Electric 82V ENX 360W projection bulb having a color temperature of 33300° K. The light intensity on the image stage is 0.46 $W/cm^2 \pm 0.05$ $W/cm^2$.

In a preferred embodiment, the o-nitro-substituted aryl group is joined through an acyclic methine chain containing an even or odd number of methine groups to a 5- or 6-membered basic, cyanine dye-type heterocyclic nucleus. The heterocyclic nucleus can have additional carbocyclic and heterocyclic rings fused thereto. The o-nitro-substituted aryl group can contain a phenyl or heterocyclic nucleus, or can contain a nucleus formed by fused aromatic or heteroaromatic rings, such as naphthyl and the like. U.S. Pat. Nos. 3,984,248, 3,988,154, 3,988,156, and 4,271,263 disclose certain members of the o-nitroarylidene dyes as acutance agents in thermally-developable photosensitive layers. U.S. Pat. No. 4,095,981 discloses certain members of the o-nitroarylidene dyes as energy sensitive dyes in silver based photographic or photothermographic materials.

In a specific preferred embodiment of this invention, the o-nitro-substituted dyes have the general Formula 1:

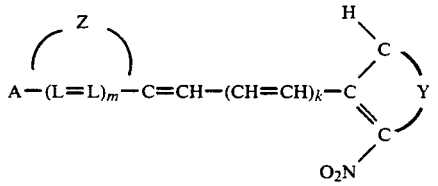

wherein k represents 0 or 1;

m represents 0 or 1;

each L represents a methine group, including substituted methine groups (e.g., —CH=, —C(CH3)=, etc.);

A represents an electron donating moiety, such as oxygen (—O—), sulfur (—S—), or

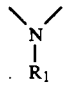

$R_1$ represents (1) an alkyl group having from 1 to 18 carbon atoms and preferably a lower alkyl group having from 1 to 4 carbon atoms (e.g., methyl, ethyl, propyl, isopropyl, butyl, sec-butyl, isobutyl, tert-butyl); a sulfoalkyl group, preferably sulfo lower alkyl containing from 1 to 4 carbon atoms in the alkyl moiety (e.g., β-sulfoethyl, γ-sulfopropyl, γ-sulfobutyl, etc.); a carboxyalkyl group, preferably a carboxy lower alkyl containing from 1 to 4 carbon atoms in the alkyl moiety (e.g., β-carboxyethyl, γ-carboxypropyl, δ-carboxybutyl, etc.); a sulfatoalkyl group, preferably a sulfato lower alkyl containing 1 to 4 carbon atoms in the alkyl moiety (e.g., β-sulfatoethyl, γ-sulfatopropyl, δ-sulfatobutyl, etc.); an alkoxyalkyl group, preferably a lower alkoxy lower alkyl containing from 1 to 4 carbon atoms in both the alkoxy and alkyl moieties (e.g., β-methoxyethyl, γ-methoxypropyl, δ-propoxybutyl, etc.); an acyloxyalkyl group preferably an acyloxy lower alkyl containing from 1 to 4 carbon atoms in the alkyl moiety (e.g., acetyloxyethyl, propanoyloxyethyl, butanoyloxybutyl, benzoyloxyethyl, toluyloxypropyl, etc.); an alkoxycarbonylalkyl group, preferably a lower alkoxy carbonyl lower alkyl containing from 1 to 4 carbon atoms in both the alkoxy and alkyl moieties (e.g., β-methoxycarbonylethyl, δ-ethoxycarbonylbutyl, β-butoxycarbonylethyl, etc.); a dialkylaminoalkylene group, preferably a di-lower alkylamino lower alkylene containing from 1 to 4 carbon atoms in the alkylene and the alkyl moieties (e.g., dimethylaminoethylene, diethylaminopropylene, diethylaminobutylene, etc.); a cycloaminoalkylene group, preferably cycloamino lower alkyl containing 4 to 6 atoms in the cycloamino moiety and 1 to 4 atoms in the alkyl moiety (e.g., pyrrolidinylethylene, morpholinopropylene, piperidinebutylene, pyrrolidinylmethylene, etc.); (2) an alkenyl group (including a substituted alkenyl group), preferably a lower alkenyl containing 2 to 4 carbon atoms (e.g., ethyl, allyl, 1-propenyl, 1-butenyl, 2-butenyl, etc.); or (3) an aryl group (including a substituted aryl), such as phenyl, naphthyl, tolyl, xylyl, halophenyl (e.g., p-chlorophenyl, p-bromophenyl, etc.), alkoxyphenyl (such as methoxyphenyl, 2,4-dichlorophenyl, etc.), and an alkyl group, preferably an aryl lower alkyl containing from 1 to 4 carbon atoms in the alkyl moiety (e.g., benzyl, β-phenethyl, ω-phenbutyl, etc.); or (4) hydrogen; and Y represents the atoms necessary to complete an aryl (preferably phenyl or naphthyl) ring which is o-nitro-substituted and preferably is also p-substituted with a nitro or other electron withdrawing group and which aryl ring can have other substituents attached to it and other carbocyclic rings fused to it (e.g., 2-nitrophenyl, 2,4-dinitrophenyl, 2,6-dinitrophenyl, 2,4,6-trinitrophenyl, 2--nitronaphthyl, 2,4-dinitronaphthyl, 2-nitro-4-cyanophenyl, 2-nitro-4-ethoxycarbonylphenyl, 2-nitro-4-trifluoromethylphenyl, and the like); and Z represents the nonmetallic atoms necessary to complete a heterocyclic nucleus of the type used in cyanine dyes containing 5 or 6 atoms in the heterocyclic ring containing the electron-donating atom of the formula which ring can contain a second heteroatom such as oxygen, nitrogen, selenium, or sulfur. The heterocyclic nucleus preferably is selected from the group consisting of thiazole nucleus including substituted and unsubstituted benzothiazole and naphthothiazole nuclei and like (e.g., thiazole, 4-methylthiazole, 4-phenylthiazole, 4,5-diphenylthiazole, 4-(2-thienyl)thiazole, benzothiazole, 4-chlorobenzothiazole, 4-methylbenzothiazole, 4-methoxybenzothiazole, 4-ethoxybenzothiazole, 4-phenylbenzothiazole, 5-chlorobenzothiazole, 5-bromobenzothiazole, 5-methylbenzophenylbenzothiazole, 5-methoxybenzothiazole, 5-ethoxybenzothiazole, 6-chlorobenzothiazole, 6-ethoxybenzothiazole, 5-methoxynaphtha[2,3-d]thiazole, 5-nitrobenzothiazole, 6-nitrobenzothiazole, 5-chloro-6-nitrobenzothiazole, etc.); an oxazole nucleus including substituted and unsubstituted benzoxazole and naphthoxazole nuclei and the like (e.g., oxazole, 4-phenyloxazole, benzoxazole, 5-chlorobenzoxazole, 5-methylbenzoxazole, 5-bromobenzoxazole, 5-methoxybenzoxazole, 5-ethoxybenzoxazole, 5-phenylbenzoxazole, 5-nitrobenzoxazole, 6-nitrobenzoxazole, 5-chloro-6-nitrobenzoxazole, etc.); a selenazole nucleus including substituted or unsubstituted benzoselenazole and naphtoselenazole nuclei and the like (e.g., selenazole, 4-methylselenazole, 4-nitroselenazole, 4-phenylselenazole, benzoselenazole, 5-chlorobenzoselenazole, 6-chlorobenzoselenazole, naphtho[2,1-l]selenazole, 5-nitrobenzoselenazole, 6-nitrobenzoselenazole, 5-chloro-6-nitrobenzoselenazole, nitrogroup substituted naphthoselenazoles, etc.); a thiazoline nucleus (e.g., thiazoline, 4-methylthiazoline, 4-nitrothiazoline, etc.); a 2-pyridine nucleus, (e.g., 2-pyridine, 5-methyl-2-pyridine, etc.); a 4-pyridine nucleus (e.g., 4-pyridine, 3-methyl-4-pyridine, nitrogroup substituted pyridines, etc.); a 3,3-dialkylindolenine nucleus (e.g., 3,3-dimethylindolenine, 3,3-diethyl-5- or 6-cyanoindolenine, 3,3-diethyl-5- or 6-nitroindolenine, 3,3-dimethyl-5- or 6-nitroindolenine, etc.); an imidazole nucleus (e.g., imidazole; 1-alkylimidazole; benzimidazole; 1,3-dialkyl, 1,3-diaryl, or 1-alkyl-3-arylimidazoles and benzimidazoles (e.g., 5-chloro-1,3-dialkylbenzimidazoles, 5-chloro-1,3-diarylbenzimidazoles, 5-methoxy-1,3-dialkylbenzimidazoles, 5-methoxy-1,3-diarylbenzimidazoles, 5-cyano-1,3-dialkylbenzimidazoles, 5-cyano-1,3-diarylbenzimidazoles, 1,3-dialkylnaphth[1,2-d]imidazole, 1,3-diarylnaphth[1,2-d]imidazole), etc.); a quinoline nucleus (e.g., quinoline, 6-methylquinoline, 6-methoxyquinoline, 6-ethoxyquinoline, 6-ethoxyquinoline, 6-chloroquinoline, 4-methoxyquinoline, 4-methylquinoline, 8-methoxyquinoline, 2-methylquinoline, 4-chloroquinoline, 6-nitroquinoline, etc.); an imidazo[4,5-b]quinoxaline nucleus (e.g., imidazo[4,5-b]quinoxaline, 1,3-dialkylimidazo[4,5-b]quinoxaline such a 1,3-diethylimidazo[4,5-b]quinoxaline, 6-chloro-1,3-diethylimidazo[4,5-b]quinoxaline, etc.; 1,3-dialkenylimidazo[4,5-b]quinoxaline such as 1,3-diallylimidazo[4,5-b]quinoxaline, 6-chloro-1,3-diallylimidazo[4,5-b]quinoxaline, etc.; 1,3-diarylimidazo[4,5-b]quinoxaline such as 1,3-diphenylimidazo[4,5-b]quinoxaline, 6-chloro-1,3-diphenylimidazo[4,5-b]quinoxaline, etc.); a 3H-pyrrolo[2,3-b]pyridine nucleus, (e.g., 3,3-dialkyl-3H-pyrrolo[2,3-b]pyridine such as 3,3-dimethyl-3H-pyrrolo[2,3-b]pyridine, 3,3-diethyl-3H-pyrrolo[2,3-b]pyridine, 1,3,3-trialkyl-3H-pyrrolo[2,3-b]pyridine such as 1,3,3-triethyl-3H-pyrrolo[2,3-b]pyridine, etc.); and a thiazolo[4,5-b]quinoline nucleus, a pyrylium (including benzopyrylium, thiapyrylium, and benzothiapyrylium) nucleus, and a dithiolinium nucleus.

In a second preferred embodiment of this invention the sensitizer is represented by Formula 2:

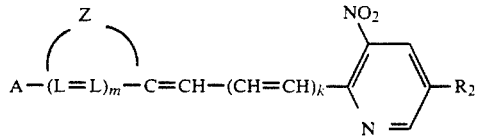

wherein

A, L, Z, k, and m are as previously defined, and $R_2$ represents hydrogen, nitro, cyano, a carboalkoxy group of from 2 to 19 carbon atoms, or halogen.

In a third preferred embodiment of this invention other dyes useful as photobleachable sensitizers of this invention include 5-nitropyrimidyl-4-idene dyes as given in Formula 3. 5-Nitropyrimidyl-4-idene dyes contain a 5-nitro-substituted pyrimidyl group joined at the position through a methine chain linkage to a basic heterocyclic nucleus containing an electron-donating atom, typically a nitrogen, oxygen, or sulfur electron-donating atom. Formula 3 is

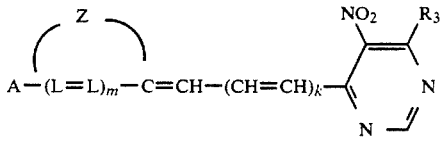

wherein $R_3$ represents halogen; and

A, L, Z, k, and m are defined as above.

In a fourth preferred embodiment, shown by Formula 4, the o-nitro-substituted aryl group is joined through an acyclic methine chain containing an even number of methine groups to a disubstituted amino group so as to form an enamine. The disubstituted amino group can be part of a heteroalkyl or heteroaromatic ring which can have additional carbocyclic and heterocyclic rings fused thereto. The o-nitro-substituted aryl group can contain a phenyl or heterocyclic nucleus, or can contain a nucleus formed by fused aromatic or heteroaromatic rings, such as naphthyl and the like. Formula 4 is given by

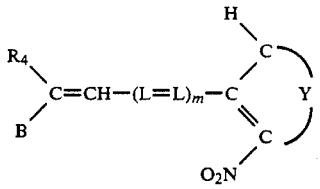

wherein

L and Y are as previously defined; and m is an integer from 0 to 5, inclusive.

$R_4$ is chosen from hydrogen, an alkyl group having from 1 to 18 carbon atoms, and preferably a lower alkyl group having from 1 to 4 carbon atoms (e.g., methyl, ethyl, propyl, isopropyl, butyl, sec-butyl, isobutyl, tert-butyl); an aryl group having from 1 to 20 carbon atoms, preferably phenyl; an alkaryl group, preferably lower alkaryl having from 7 to 11 carbon atoms (e.g., tolyl, ethylphenyl, propylphenyl); an aralkyl group, preferably lower aralkyl having from 7 to 11 carbon atoms (e.g., phenylmethyl, phenethyl, phenylpropyl); heteroaromatic (e.g., pyridyl, pyrimidyl, quinolinyl); an alkoxyalkyl group, preferably a lower alkoxy lower alkyl containing from 1 to 4 carbon atoms in both the alkoxy and alkyl moieties (e.g., β-methoxyethyl, γ-methoxypropyl, δ-propoxybutyl, etc.); an alkoxycarbonylalkyl group, preferably a lower alkoxy carbonyl lower alkyl containing from 1 to 4 carbon atoms in both the alkoxy and alkyl moieties (e.g., β-methoxycarbonylethyl, δ-ethoxycarbonylbutyl, β-butoxycarbonylethyl, etc.); or halogen.

B may be chosen from amino; alkylamino, preferably lower alkylamino having from 1 to 6 carbon atoms (e.g., methylamino, ethylamino, propylamino, isopropylamino, hexylamino, etc.); dialkylamino, preferably lower dialkylamino with each alkyl group individually having from 1 to 6 carbon atoms (e.g., dimethylamino, diethylamino, ethylmethylamino, propylhexylamino, etc.); cycloalkylamino, preferably lower cycloalkylamino having from 2 to 6 carbon atoms (e.g., cyclopentylamino, cyclohexylamino, etc.); morpholino and substituted morpholinopiperazino and substituted piperazino; arylamino, preferably phenyl or substituted phenylamino (e.g., chlorophenylamino, dimethylphenylamino, etc.); diarylamino, preferably with each aryl group individually being phenyl or substituted phenyl (e.g., diphenylamino, tolylphenylamino, etc.)

The photobleachable sensitizer should be present as at least 0.05 percent by weight of the total weight of the dried imaging layer, up to 1.5 percent by weight or more. Preferably, they are present at from 0.075 to 1.25 percent by total weight of the layer and most preferably from 0.1 to 1.0 percent.

BINDER

Any natural or synthetic water-insoluble polymeric binder may be used in the practice of this invention. Organic polymeric resins, preferably thermoplastic resins (although thermoset resins may be used) are generally preferred. Where speed is important, water-insoluble, water impermeable, water resistant polymers should be used and an acid should be added to the system to increase the rate of colorizing (i.e., leuco dye oxidation). Such resins as phenoxy resins, polyesters, polyvinyl resins, polycarbonates, polyamides, polyvinyl acetals, polyvinylidene chloride, polyacrylates, cellulose esters, copolymers and blends of these classes of resins, and others have been used with particular success. Where the proportions and activities of leuco dyes and nitrate ion require a particular developing time and temperature, the resin should be able to withstand those conditions. Generally, it is preferred that the polymer not decompose or lose its structural integrity at 200° F. (93° C.), for 30 seconds and most preferred that it not decompose or lose its structural integrity at 260° F. (127° C.).

Preferred polymers include polyvinylidene chloride resins (e.g., Saran TM supplied by Dow Chemical Co.), phenoxy resins (e.g., PKHH TM and PAHJ TM supplied by Union Carbide Chemical Corp.), and polyvinyl formals (e.g., Formvar TM supplied by Monsanto Chemical Corp.).

Beyond these minimal requirements, there is no criticality in the selection of a binder. In fact, even transparency and translucency are not required although they are desirable.

The binder serves a number of additionally important purposes in the constructions of the present invention. The imageable materials are protected from ambient conditions such as moisture. The consistency of the coating and its image quality are improved. The durability of the final image is also significantly improved. The binder should be present as at least about 25% by weight of ingredients in the layer, more preferably as 50% or 70% by weight and most preferably as at least about 80% by total weight of dry ingredients (i.e., excluding solvents in the layer). A generally useful range is 30–98% by weight binder with 75–95% preferred.

NITRATE SALT

Nitrate salts themselves are well known. They may be supplied as various chemical compounds, but are desirably provided as a metal salt, and most preferably provided as a hydrated metal salt. Other ions which are ordinarily good oxidizing ions such as nitrite, chlorate, iodate, perchlorate, periodate, and persulfate do not provide comparable results. Extremely active oxidizing agents, such as iodate, even used in relatively smaller proportions to prevent complete and immediate oxidation or colorization of the dyes do not perform nearly as well as nitrate ion compositions.

The performance of nitrate is so far superior to any other ion that it is apparently unique in the practice of the present invention. Most means of supplying the nitrate salt into the layer are satisfactory, for example, organic salts, metal salts, acid salts, mixtures of acids and salts, and other means of supplying the ion are useful. For example, nitrates of zinc, cadmium, potassium, calcium, zirconyl ($ZrO_2$), nickel, aluminum, chromium, iron, copper, magnesium, lithium, lead and cobalt, ammonium nitrate, cerous ammonium nitrate, and combinations of the above have been used.

The nitrate salt component of the present invention is desirably present in a form within the imaging layer so the oxidizing quantities of $HNO_3$, NO, $NO_2$, or $N_2O_4$ will be provided within the layer when it is heated to a temperature no greater than 200° C. for 60 seconds and preferably no greater than 160° C. for 60 or most preferably 30 seconds. This may be accomplished with many different types of salts, both organic and inorganic, and in variously different types of constructions.

The most convenient way of providing such thermal oxidant providing nitrate salts is to provide a hydrated nitrate salt such as magnesium nitrate hexahydrate ($Mg(NO_3)_2 \times 6H_2O$). In addition to hydrated nitrate salts, non-hydrated salts such as ammonium nitrate, pyridinium nitrate, and guanidinium nitrate in an acidic environment are also capable of providing the oxidizing capability necessary for practice of the present invention.

Besides the inorganic types of salts generally described above, organic salts in non-alkaline environments are also quite useful in the practice of the present invention. In particular, nitrated quaternary ammonium salts such as guanidinium nitrate work quite well in acid environments, but will not provide any useful image in a basic environment.

It is believed that the alkaline environment causes any oxidizing agent (e.g., $HNO_3$, NO, $NO_2$, and/or $N_2O_4$) which is liberated from the nitrate salt to be neutralized so as to prevent oxidation of the leuco dyes. For this reason it is preferred to have an acidic environment for the nitrate salt.

One other consideration should be given in the selection of the nitrate salt, namely the choice of a salt in which the cation is non-reactive with the dye. Non-reactive salts are defined in the practice of the present invention as those salts whose cations do not spontaneously oxidize the dyes that they are associated with at room temperature. This may be determined in a number of fashions. For example, the dye and a non-nitrate (preferably halide) salt of the cation may be co-dissolved in a solution. If the salt oxidizes the dye spontaneously (within two minutes) at room temperature, it is a reactive salt. Such salts as silver nitrate, in which the cation itself is a strong oxidizing agent, is a reactive salt. Ceric nitrate is also reactive, while hydrated cerous nitrate is not.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, gadolinium or lanthanum nitrate nonahydrate, mixtures of these hydrated nitrates and the like. Nonhydrated (e.g., lithium nitrate) or organic nitrates may be admixed therewith.

Organic nitrates are also quite useful in the practice of the present invention. These nitrates are usually in the form of quarternary nitrogen containing compounds such as guanidinium nitrate, pyridinium nitrate, and the like. It is preferred to have at least 0.10 moles of nitrate ion per mole of leuco dye. It is more preferred to have at least 0.30 or 0.50 moles of ion per mole of dye. The nitrate ordinarily constitutes from 0.05 to 10 percent by weight of the imaging layer, preferably 0.1 to 10 percent and most preferably 0.5 to 8 percent by weight.

LEUCO DYES

Leuco dyes are well known. These are colorless compounds which when subjected to an oxidation reaction form colored dyes. These leuco dyes are well described in the art (e.g., U.S. Pat. No. 3,974,147; *The Theory of Photographic Process*, 3rd Ed.; Mees, C. E. K.; James, R.; MacMillan: New York, 1966; pp 283–284, 390–391; and Kosar, J. Light-Sensitive Systems; John Wiley and Sons: New York, 1965; pp 367, 370–380, 406. Only those leuco dyes which can be converted to colored dyes by oxidation are useful in the practice of the present invention. The preferred leuco dyes are the acylated leuco diazine, phenoxazine, and phenothiazine dyes examples of which are disclosed in U.S. Pat. Nos. 4,460,677, 4,647,525, and G.B. Pat. No. 1,271,289.

Acid or base sensitive dyes such as phenolphthalein and other indicator dyes are not useful in the present invention. Indicator dyes form only transient images and are too sensitive to changes in the environment. The leuco dye should be present as at least about 0.3 percent by weight of the total weight of the light-sensitive layer, preferably at least 1 percent by weight, and most preferably at least 2 percent to 10 percent or more (e.g. 15 percent) by weight of the dry weight of the imageable layer. About 10 mole percent of the nitrate/leuco dye is minimally used, with 20 to 80 mole percent preferred and from 35 to 65 mole percent most preferred. Molar percentages of nitrate/dye in excess of 100 percent are definitely useful. The leuco dye ordinarily constitutes from 0.5 to 15 percent by weight of the imaging layer preferably 2 to 8 percent.

INITIATORS

The term initiator as used herein refers to either a diaryliodonium salt, or an photolyzable organic halogen compound. Each of the two classes of initiators are known in the art.

The diaryliodonium salts of the present invention may be generally described by the formulae:

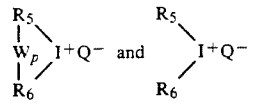

wherein $R_5$ and $R_6$ are individually selected from aromatic groups. Such aromatic groups may have from 4 to 20 carbon atoms (e.g., substituted or unsubstituted phenyl, naphthyl, thienyl, and furanyl) with substantially any substitution, W is selected from a carbon-carbon bond, oxygen, sulfur,

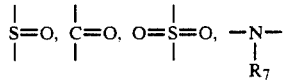

wherein $R_7$ is aryl (e.g., 6 to 20 carbon atoms) or acyl (e.g., 2 to 20 carbon atoms), or $R_8$—C—$R_9$ wherein $R_8$ and $R_9$ are selected from hydrogen, alkyl groups of 1 to 4 carbon atoms, and alkenyl groups of 2 to 4 carbon atoms, p is 0 or 1, and $Q^-$ is any anion.

Where the term group is used in describing substituents, substitution is anticipated on the substituent for example, alkyl group includes ether groups (e.g., $CH_3$—$CH_2$—$CH_2$—O—$CH_2$—), haloalkyls, nitroalkyls, carboxy alkyls, hydroxy alkyls, etc. while the term alkyl includes only hydrocarbons. Substituents which react with active ingredients, such as very strong reducing or oxidizing substituents, would of course be excluded as not being sensitometrically inert or harmless.

The photolyzable organic halogen compounds are those that upon exposure to radiation dissociate at one or more carbon-halogen bonds to form free radicals. The carbon-halogen bond dissociation energy should be between about 40 and 70 kilocalories per mole as taught in U.S. Pat. Nos. 3,515,552 and 3,536,481. Preferred halogen compounds are nongaseous at room temperature and have a polarographic half-wave reduction potential greater than about −0.9 V as described in U.S. Pat. Nos. 3,640,718, 3,617,288, and 3,779,778.

Examples of diaryliodonium cations useful in the practice of the present invention are diphenyliodonium, di(4-chlorophenyl)iodonium, 4-trifluoromethylphenylphenyliodonium, 4-ethylphenylphenyliodonium, di(4-acetylphenyl)iodonium, tolylphenyliodonium, anisylphenyliodonium, 4-butoxyphenylphenyliodonium, di(4-phenylphenyl)iodonium, di(carbomethoxyphenyl)iodonium, etc. Examples of the iodonium cations are disclosed in U.S. Pat. Nos. 3,729,313, 4,076,705, and 4,386,154. Bis-type forms of these initiators may also be used.

Examples of photolyzable organic halogen compounds are hexabromoethane, α,α,α′,α′-tetrabromoxylene, carbon tetrabromide, m-nitro(tribromoacetyl)benzene, α,α,α-trichloroacetanilide, trichloromethylsulfonylbenzene, tribromoquinaldine, bis(pentachlorocyclopentadiene), tribromomethylduinoxaline, α,α-dibromo-p-nitrotoluene, α,α,α,α′α′,α′-hexachloro-p-xylene, dibromotetrachloroethane, pentabromoethane, dibromodibenzoylmethane, carbon tetraiodide, halomethyl-s-triazines such as 2,4-bis(trichloromethyl)-6-methyl-s-triazine, 2,4,6-tris(trichloromethyl)-s-triazine, and 2,4-bis(trichloromethyl)-6-(p-methoxystyryl)-s-triazine, etc. These compounds are disclosed as noted above in U.S. Pat. Nos. 3,515,552, 3,536,489, 3,617,288, 3,640,718, 4,386,154, and 3,779,778.

ACIDIC MATERIALS

Acidic materials may be added to the light sensitive layer to increase its speed. The acids used in the present invention are acids as generally known to one skilled in the art. Organic acids are preferred, but inorganic acids (generally in relatively smaller concentrations) are also useful. Organic acids having carboxylic groups are most preferred. The acid should be present as at least about 0.1 percent by weight of the total weight of the light sensitive layer. More preferably it is present in amounts from 0.2 to 2.0 times the amount of nitrate ion. The acid may, for example, be present in a range of from 0.05 to 10 percent by weight, preferably from 0.1 to 7 percent, most preferably from 0.5 to 5 percent. Higher molecular weight acids are generally used at the higher concentrations and lower molecular weight acids used at the lower concentrations. Anhydrides such as phthalic anhydride may also be used.

In forming or coating imageable layers onto a substrate, temperatures should, of course, not be used during manufacture which would completely colorize the layer or decompose the o-nitroarylidene dyes. Some colorization is tolerable, with the initial leuco dye concentrations chosen so as to allow for anticipated changes. It is preferred, however, that little or no leuco dye be oxidized during forming and coating so that more standardized layers can be formed. Depending on the anticipated development temperature the coating or forming temperature can be varied. Therefore, if the anticipated development temperature were, for example, 220° F. (104° C.), the drying temperature would be 140° F. (60° C.). It would therefore not be likely for the layer to gain any of its optical density a drying temperature in less than 6–7 minutes. A reasonable development temperature range is between 160° F. (71° C.) and 350° F. (177° C.) and a reasonable dwell time is between 3 seconds and 2 minutes, preferably at between 175° F. (79° C.) and 250° F. (121° C.) and for 5 to 60 seconds, with the longer times most likely associated with the lower development temperatures.

The imaging layers of the present invention must under some conditions allow reactive association amongst the active ingredients in order to enable imaging. That is, the individual ingredients may not be separated by impenetrable barriers (i.e., which cannot be dissolved, broken, or disrupted during use) within the layer. Generally the active ingredients are homogeneously mixed (e.g., a molecular mixture) within the layer. They may be individually maintained in heat softenable binders which are dispersed or mixed within the layer and which soften upon heating to allow migration of ingredients, but this would require a longer development time. The ingredients may be incorporated into a binder medium, fine particles of which may be subsequently dispersed in a second layer binder medium. This has similarly been done with dry silver photothermographic media in U.S. Pat. No. 4,708,928.

The imaging layers of the present invention may contain various materials in combination with the essential ingredients of the present invention. For example, plasticizers, coating aids, antioxidants (e.g., ascorbic acid, hindered phenols phenidone, etc. in amounts that would prevent oxidation of the dyes when heated), surfactants, antistatic agents, waxes, ultraviolet radiation absorbers, mild oxidizing agents in addition to the nitrate, and brighteners may be used without adversely affecting the practice of the invention. One noteworthy property of this system is amplification of the latent image. By amplification in the leuco dye containing construction is meant that more than one molecule of dye is formed for each absorbed photon of radiation. The degree of amplification, that is the ratio of the number of dye molecules formed to photons absorbed, may be as high as $1\times10^3$.

An essential aspect of this invention is that photobleachable spectral sensitizers may be combined with a nitrate salt, leuco dye, and initiator to provide a light-sensitive thermally developable imaging system without residual sensitizer stain in exposed regions after development, and that upon a further blanket exposure residual sensitizer stain in unexposed regions can be removed, thereby improving contrast, color fidelity over the entire visible spectrum, and light fastness of the developed imaging system.

Additionally, since the sensitizers of this invention are photobleachable they may be incorporated at unusually high concentrations which would be completely unacceptable due to extreme levels of sensitizer stain in the developed image. Photolysis of photobleachable sensitizers at these high concentrations can still occur efficiently, since photolyzed material does not serve to filter incident radiation from unphotolyzed sensitizer. Under identical conditions, non-photobleachable sensitizers are photolyzed to give products which filter incident light and prevent absorption by unphotolyzed sensitizer, thereby reducing photoefficiency of the imaging composition.

These and other aspects of the present invention such as the advantages over the prior art will be shown in the following examples.

EXAMPLES

All materials which were prepared in the following examples were evaluated and characterized by a selection or combination of $^1$H nuclear magnetic resonance (NMR), infrared (IR), and ultraviolet (UV) spectroscopies. Spectra obtained were consistent with the assignments given below. All reagents can be purchased from Aldrich Chemical (Milwaukee, Wis.), unless otherwise specified. The following chemical abbreviation were used in the examples which follow: ethanol (EtOH), methanol (MeOH), tetrahydrofuran (THF).

The term "appropriate safelights" as used herein means room lighting conditions of such wavelengths that neither the components nor the complete imageable layer will be photosensitive to them.

The term "fog" as used herein means the optical density in the unexposed region.

EXAMPLES 1–6

These examples teach the preparation of some o-nitroarylidene dyes useful as photobleachable sensitizers in the practice of this invention.

The o-nitroarylidene dyes which are shown in Table 1 were prepared according to the general procedures described in U.S. Pat. No. 3,988,154.

TABLE 1

| Example | Dye | $\lambda_{max}$ (nm) in PKHH[a] |
|---|---|---|
| 1 | 1 | 534 |
| 2 | 2 | 586 |
| 3 | 3 | 507 |
| 4 | 4 | 471 |
| 5 | 5 | 610 |
| 6 | 6 | 657 |

[a]PKHH is a phenoxy resin obtained from Union Carbide, Hackensack, NJ.

EXAMPLES 7-18

These examples demonstrate that the photobleachable sensitizing dyes of Examples 1-6 are useful in the present invention.

A coating solution was made up of the following components: 7.5 g of 20% PKHH TM in THF, 80 mg of the benzoyl leuco of Basic Blue 3 (Pergascript Turquoise TM, Ciba-Geigy, Ardsley, N.Y.), 4 to 9 mg sensitizer dye, 940 mg solution of 9 g MeOH, 0.26 g $Mg(NO_3)_2 \times 6H_2O$, 0.14 g succinic acid; and 60 mg of either 2,4,6-tris(trichloromethyl)-1,3,5-triazine (TTT), or diphenyliodonium hexafluorophosphate ($Ph_2I$).

The solution was placed on a shaker table for 15 minutes at room temperature in a dark room. Under appropriate safelights, the solution was knife-coated upon 4 mil (0.1 mm) transparent polyethylene terephthalate film at 4 mil (0.1 mm) wet thickness, and at 66° C. for 3.25 minutes. Several duplicate strips (approximately 8"×2") were cut from this film and used for the following test.

The development temperature of the dried film was determined by exposing lengthwise one-half of an 8"×2" (20.3×5.1 cm) strip on a 3M brand "179" Contact Printer Processor containing a white tungsten light source for 20 seconds at the 32 exposure setting (about $8.5 \times 10^5$ microwatts/cm$^2$). The strip was placed on a Reichert Heizbank thermal gradient apparatus (Cambridge Instruments, Buffalo, N.Y.), for 20 seconds and the thermal limits (the temperature at which development occurs), were determined for the exposed ($T_{exp}$) and unexposed ($T_{unexp}$) regions. The results are presented in Table 2.

TABLE 2

| Example | Dye | Initiator | Thermal Limit $T_{unexp}$ (°C.) | $T_{exp}$ (°C.) |
|---|---|---|---|---|
| 7 | 1 | TTT | 83 | 73 |
| 8 | 1 | $Ph_2I$ | 94 | 80 |
| 9 | 2 | TTT | 88 | 86 |
| 10 | 2 | $Ph_2I$ | 98 | 95 |
| 11 | 3 | TTT | 87 | 72 |
| 12 | 3 | $Ph_2I$ | 94 | 80 |
| 13 | 4 | TTT | 88 | 76 |
| 14 | 4 | $Ph_2I$ | 100 | 97 |
| 15 | 5 | TTT | 120 | 100 |
| 16 | 5 | $Ph_2I$ | 108 | 105 |
| 17 | 6 | TTT | 108 | 100 |
| 18 | 6 | $Ph_2I$ | 109 | 107 |

EXAMPLES 19-30

Duplicate strips to those of Examples 7-18 were subjected to the following tests.

The amount of photobleaching was determined by the following procedure: one half of a strip was exposed on a 3M brand Model 213 OverHead Projector for 5 minutes. The UV spectrum of the unexposed film was taken, the $\lambda_{max}$ was determined, and the optical density of the exposed strip was measured at the $\lambda_{max}$. The photothermographic speed was determined by the following procedure: one half of a strip was exposed lengthwise through a Stouffer $\sqrt{2}$, 21 step tablet (Stouffer Graphic Arts Equipment, South Bend, Ind.), on a 3M brand "179" Contact Printer Processor or 10 seconds at an exposure setting of 32 (approximately $1.4 \times 10^4$ ergs sec/cm$^2$ for 450-900 nm). The strip was processed for 20 seconds at a temperature between $T_{unexp}$ and $T_{exp}$ (from Examples 7-18), at which a background density of <0.2 was observed. The speed, in number of steps, was determined at the point where the density is 0.6+fog. The results are presented in Table 3.

TABLE 3

| Example | Dye | Initiator | Steps 0.6 + fog | % Photobleach |
|---|---|---|---|---|
| 19 | 1 | TTT | 11.0 | 98 |
| 20 | 1 | $Ph_2I$ | 6.5 | 95 |
| 21 | 2 | TTT | <2.0 | 85 |
| 22 | 2 | $Ph_2I$ | <2.0 | 89 |
| 23 | 3 | TTT | 7.5 | 96 |
| 24 | 3 | $Ph_2I$ | 3.5 | 94 |
| 25 | 4 | TTT | 6.0 | 78 |
| 26 | 4 | $Ph_2I$ | 3.0 | 83 |
| 27 | 5 | TTT | 6.0 | 75 |
| 28 | 5 | $Ph_2I$ | 2.0 | 75 |
| 29 | 6 | TTT | 3.0 | 88 |
| 30 | 6 | $Ph_2I$ | <2.0 | 88 |

EXAMPLE 31

The following example demonstrates that the photobleachable sensitizers of this invention can be different from those of the photothermographic systems of U.S. Pat. Nos. 4,386,154 and 4,460,677. A test analogous to the sensitizing dye test specified in U.S. Pat. Nos. 4,386,154 and 4,460,677 was performed. A standard test solution was prepared with the following composition: 5.0 g of 5% (weight by volume) solution in methyl ethyl ketone of polyvinylbutyral (45,000-55,000 molecular weight, 9.0-13.0% hydroxyl content, Butvar TM -B76, Monsanto Chem. Co., St. Louis, Mo.), 0.3 g of trimethylolpropane trimethacrylate, and 0.03 g of 2-methyl-4,6-bis(trichloromethyl)-1,3,5-triazine.

To this solution was added 0.02 g of the indicated dye. The solution was knife coated onto a 2 mil (0.05 mm) transparent polyethylene terephthalate film using a knife orifice of 2.0 mil, and the coating was air dried for 30 minutes. Another 2 mil (0.05 mm) transparent polyethylene terephthalate film was carefully placed over the dried but soft and tacky coating with minimum entrapment of air. The sandwiched construction was then exposed for 15 seconds to a 3M Model 70 light source (650 watt tungsten lamp) through a template with clear and opaque areas. This procedure essentially photobleached the dyes 1 and 3 in the light exposed areas. After exposure the cover film was removed, and the coating was treated with a finely divided black toner powder of the type conventionally used in xerography. If the tested material was a sensitizer as described in U.S. Pat. No. 4,386,154, the trimethylolpropane trimethacrylate monomer in the light exposed areas would be polymerized by the light generated free radicals from the photolyzable organic halogen compound, i.e., 2-methyl-4,6-bis(trichloromethyl)-1,3,5-triazine. Since the polymerized areas are essentially tack free, the black toner powder selectively adheres to the tacky, unexposed areas of the coating, providing a visual image corresponding to that in the template. The results are shown below and are compared with a sensitizing dye (5,10-diethoxy-16,17-dimethoxyviolanthrene) of the prior art. Table 4 demonstrates the present invention is outside the scope of the prior art as described in U.S. Pat. Nos. 4,386,154 and 4,460,677.

TABLE 4

| Dye | Toner Image |
|---|---|
| 1 | No |
| 3 | No |
| 5,10-diethoxy-16,17-dimethoxy-violanthrene | Yes |

EXAMPLES 32–41

These examples teach the preparation of some o-nitropyridyl-2-idene and o,p-dinitropyridyl-2-idene dyes useful as photobleachable sensitizers in the practice of this invention. A general procedure for the preparation of the o-nitropyridyl-2-idene and the o,p-dinitropyridyl-2-idene dyes 7–26 shown in Table 5 follows: to a refluxing solution of 2.5 mmol of the appropriate 2- or 4-alkyl quaternary salt (as described in U.S. Pat. No. 4,111,699); 2.5 mol of 2-chloro-3-nitropyridine or 2-chloro-3,5-dinitropyridine, and 30 ml dry acetonitrile (distilled from calcium hydride) was added 5 ml of diisopropylethylamine over 5 minutes dropwise. The reaction mixture was held at reflux for an additional 5 hours. The resulting dark mixture was allowed to cool and stand overnight. The precipitate was filtered, washed with acetonitrile, and dried to afford product.

TABLE 5

| Example | Dye | $\lambda_{max}$ (nm) |
|---|---|---|
| 32 | 7 | 550 ($CH_3CN$) |
| 33 | 8 | 586 ($CH_3CN$) |
| 34 | 9 | 530 ($CH_2Cl_2$) |
| 35 | 10 | 545 ($CH_2Cl_2$) |
| 36 | 11 | 536 ($CH_2Cl_2$) |
| 37 | 12 | 540 ($CH_2Cl_2$) |
| 38 | 13 | 566 ($CH_2Cl_2$) |
| 39 | 14 | 500 ($CH_2Cl_2$) |
| 40 | 15 | 531 ($CH_2Cl_2$) |
| 41 | 16 | 470 ($CH_2Cl_2$) |

EXAMPLES 42–59

This example demonstrates that the photobleachable sensitizing dyes of Examples 32–41 are useful in the present invention. Coated film samples were prepared and evaluated according to the procedure of Examples 7–12. The results are presented in Table 6.

TABLE 6

| Example | Dye | Initiator | Thermal $T_{unexp}$ (°C.) | Limit $T_{exp}$ (°C.) |
|---|---|---|---|---|
| 42 | 7 | TTT | 100 | 90 |
| 43 | 7 | $Ph_2I$ | 125 | 121 |
| 44 | 8 | TTT | 115 | 100 |
| 45 | 8 | $Ph_2I$ | 128 | 121 |
| 46 | 9 | TTT | 108 | 95 |
| 47 | 9 | $Ph_2I$ | 124 | 120 |
| 48 | 10 | TTT | 120 | 105 |
| 49 | 10 | $Ph_2I$ | 118 | 115 |
| 50 | 11 | TTT | 120 | 98 |
| 51 | 11 | $Ph_2I$ | 122 | 118 |
| 52 | 12 | TTT | 112 | 98 |

TABLE 6-continued

| Example | Dye | Initiator | Thermal $T_{unexp}$ (°C.) | Limit $T_{exp}$ (°C.) |
|---|---|---|---|---|
| 53 | 12 | $Ph_2I$ | 123 | 121 |
| 54 | 13 | TTT | 120 | 98 |
| 55 | 13 | $Ph_2I$ | 122 | 120 |
| 56 | 15 | TTT | 120 | 90 |
| 57 | 15 | $Ph_2I$ | 126 | 124 |
| 58 | 16 | TTT | 125 | 110 |
| 59 | 16 | $Ph_2I$ | 121 | 118 |

EXAMPLES 60–69

Strips that were duplicates to those of Examples 42–59 were subjected to photobleaching and speed tests as described in Examples 19–30. The results are presented in Table 7.

TABLE 7

| Example | Dye | Initiator | Steps 0.6 + fog | % Photobleach |
|---|---|---|---|---|
| 60 | 7 | TTT | 4 | 99 |
| 61 | 8 | TTT | 3 | 97 |
| 62 | 9 | TTT | 4 | 94 |
| 63 | 10 | TTT | 3 | 23 |
| 64 | 11 | TTT | 5 | 21 |
| 65 | 12 | TTT | 5 | 53 |
| 66 | 13 | TTT | 2 | 21 |
| 67 | 14 | TTT | 6 | 68 |
| 68 | 15 | TTT | 4 | 20 |
| 69 | 16 | TTT | 2 | 20 |

EXAMPLE 70–77

These examples teach the preparation of some o-nitropyrimidyl-4-idene dyes useful as photobleachable sensitizers in the practice of this invention.

General procedure for the o-nitropyrimidyl-4-idene dyes 17–24: to a refluxing solution of 5.2 mmol of the appropriate 2- or 4-alkyl quaternary salt (as described in U.S. Pat. No. 4,111,699); 5.2 mol of 4,6-dichloro-5-nitropyrimidine, and 30 ml dry acetonitrile (distilled from calcium hydride) was added 5 ml diisopropylethylamine dropwise over 5 minutes. The reaction mixture was held at reflux for an additional 5 hours. The resulting dark mixture was allowed to cool and stand overnight. The precipitate is filtered, washed with acetonitrile, and dried to afford product listed in Table 8.

TABLE 8

| Example | Dye | $\lambda_{max}$ (nm) |
|---|---|---|
| 70 | 17 | 478 ($CH_2Cl_2$) |
| 71 | 18 | 499 ($CH_2Cl_2$) |
| 72 | 19 | 450 ($CH_2Cl_2$) |
| 73 | 20 | 436 ($CH_2Cl_2$) |
| 74 | 21 | 449 ($CH_2Cl_2$) |
| 75 | 22 | 404 ($CH_2Cl_2$) |

EXAMPLES 78–93

These examples demonstrate that the photobleachable sensitizing dyes of Examples 70–75 are useful in the present invention. Coated film samples were prepared and evaluated according to the procedure of Examples 7–12. The results are presented in Table 9.

TABLE 9

| Example | Sensitizer | Initiator | Thermal $T_H$ (°C.) | Limits $T_L$ (°C.) |
|---|---|---|---|---|
| 78 | 17 | TTT | 112 | 106 |
| 79 | 17 | $Ph_2I$ | 123 | 120 |

TABLE 9-continued

| Example | Sensitizer | Initiator | Thermal Limits $T_H$ (°C.) | $T_L$ (°C.) |
|---|---|---|---|---|
| 80 | 18 | TTT | 120 | 112 |
| 81 | 18 | $Ph_2I$ | 122 | 120 |
| 82 | 19 | TTT | 109 | 97 |
| 83 | 19 | $Ph_2I$ | 125 | 121 |
| 84 | 20 | TTT | 110 | 95 |
| 85 | 20 | $Ph_2I$ | 120 | 118 |
| 86 | 21 | TTT | 125 | 108 |
| 87 | 21 | $Ph_2I$ | 122 | 120 |
| 88 | 22 | TTT | 112 | 98 |
| 89 | 22 | $Ph_2I$ | 121 | 119 |

EXAMPLES 90-95

Strips that were duplicates to those of Examples 78-89 were subjected to photobleaching and speed tests as described in Examples 19-30. The results are presented in Table 10.

TABLE 10

| Example | Dye | Initiator | Steps 0.6 + fog | % Photobleach |
|---|---|---|---|---|
| 90 | 17 | TTT | 4 | 84 |
| 91 | 18 | TTT | 3 | 94 |
| 92 | 19 | TTT | 8 | 92 |
| 93 | 20 | TTT | 6 | 24 |
| 94 | 21 | TTT | 2 | 30 |
| 95 | 22 | TTT | 5 | 69 |

EXAMPLES 96 AND 97

These examples teach the preparation of some o,p-dinitrophenyl enamines which are useful as photobleachable sensitizers in the practice of the present invention.

Compound 23 is prepared from 2,4-dinitrofluorobenzene and the morpholine enamine of acetophenone (conditions to be supplied). Compound 24 is commercially available from Aldrich Chemical.

TABLE 11

| Example | Dye | $\lambda_{max}$ (nm) in PKHH |
|---|---|---|
| 96 | 23 | 440-50 |
| 97 | 24 | 469 |

EXAMPLE 98

This example demonstrates that the photobleachable sensitizing dyes of Examples 96 and 97 are useful in the present invention. Films of compounds 23 and 24 were prepared by dissolving dye 23 (0.034 g) or dye 24 (0.02 g) in 7.5 of 20% PKHH binder in THF and coating at 4 mil (0.1 mm) wet thickness onto 4 mil (0.1 mm) transparent polyethylene terephthalate film followed by oven drying at 50° C. for 5 minutes.

When employed as sensitizers in the compositions of Example 8, dye 23 with triazine initiator (TTT), afforded a negative image with a 4° to 6° C. differential with 91% photobleaching according to the method of Examples 19-30, and dye 24 afforded a 5° to 7° C. differential with 84% photobleaching.

EXAMPLES 99-102

These examples demonstrate that o-nitroarylidene dye 1 activates the thermal development in exposed areas. Solution A was prepared by mixing 26.25 g of 20% PKHH in THF, 0.28 g of the benzoyl leuco of Basic Blue 3, and 0.04 g of dye 1.

Solution B was prepared as solution A but without any added 1. Solution C was prepared by mixing 9 g of methanol, 0.26 g $Mg(NO_3)_2 \times 6H_2O$, and 0.14 g of succinic acid.

Four coating solutions were prepared by mixing 7.5 g of either A or B, 0.94 g of solution C, and 0.06 of either TTT or $Ph_2I$. Coatings were prepared according to the procedure of Examples 7-18. Strips (20.2×5.1 cm) were placed on the Reichert Heizbank apparatus for 20 seconds, and the thermal limit was determined. The results are presented in Table 12.

TABLE 12

| Example | Initiator | Dye 1 | Thermal Limit (°C.) |
|---|---|---|---|
| 99 | TTT | not present | 94 |
| 100 | TTT | present | 93 |
| 101 | $Ph_2I$ | not present | 105 |
| 102 | $Ph_2I$ | present | 104 |

Strips of the films from Examples 100 and 102 were imagewise exposed for 10 seconds on a 3M brand Model "179" Contact Printer Processor at the 32 exposure setting and afforded average thermal readings on the Heizbank of 85° C. and 97° C., respectively.

EXAMPLES 103-104

These examples demonstrate that the light sensitive layers of the present invention may be photobleached, following thermal development, to produce color images with lower background stain and improved color purity.

Films were prepared according to Examples 100 and 102. The imagewise exposed films were then thermally processed for 20 seconds at the indicated temperature to afford bright blue-cyan colored negative images of the original with magenta stain throughout. Transmission densitometer readings (Status A green indicative of magenta color, and Status A red indicative of cyan color), were determined for both $D_{max}$ (light exposed), and $D_{min}$ (unexposed) areas. The imaged and thermally processed samples were exposed for 1 minute on a 3M brand Model 213 Overhead Projector to afford a bright cyan image with much lower background stain. $D_{min}$ and $D_{max}$ densitometry readings were measured again.

The results are presented in Table 13 and show the improvement in Dmin and color purity by post-exposure bleaching.

TABLE 13

| Example | Initiator | Development Temp. (°C.) | $D_{min}$ | $D_{max}$ |
|---|---|---|---|---|
| 103 | TTT | 84 | 0.11 | 1.6[a] |
| | | | 0.54 | 0.68[b] |
| | | | 0.07 | 0.19[c] |
| 104 | $Ph_2I$ | 92 | 0.10 | 1.1[a] |
| | | | 0.32 | 0.44[b] |
| | | | 0.08 | 0.19[c] |

[a]Initial Status A red filter, prior to post-exposure step.
[b]Initial Status A green filter, prior to post-exposure step.
[c]Initial Status A green filter, following post-exposure step.

EXAMPLES 105-108

These examples demonstrate image stabilization (i.e., fixing) of the imaged and processed samples using a basic material.

The imaged, processed, and post-exposure photobleached samples of Examples 103 and 104 were used. Strips of $D_{min}$ regions of the samples (areas which has not been initially photoexposed with the imaging light source, and thus were essentially colorless), were used. For each film, one strip was placed for 5 minutes in the vapors inside a tank containing 30% aqueous ammonium hydroxide solution, and the other strip was not. The strips were then placed on a Reichert Heizbank apparatus for 20 seconds and the thermal limits were measured. Also, Status A red densitometer readings (indicative of image-dye fog), were determined in areas that had been in contact with 75° C. and 80° C. regions of the Heizbank. The results are presented in Table 14.

TABLE 14

| Example | Initiator | $NH_3$ fix | Thermal Limit (°C.) | Fog[a] | Fog[b] |
|---|---|---|---|---|---|
| 105 | TTT | none | 80 | 0.44 | 1.31 |
| 106 | TTT | 5 min. | >150 | 0.12 | 0.12 |
| 107 | $Ph_2I$ | none | 88 | 0.26 | 0.36 |
| 108 | $Ph_2I$ | 5 min. | 145 | 0.09 | 0.10 |

[a]75° C. region.
[b]80° C. region.

1

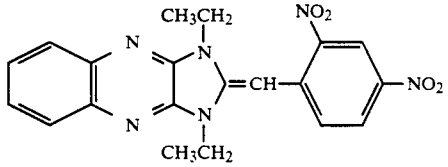

2

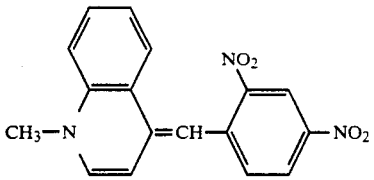

3

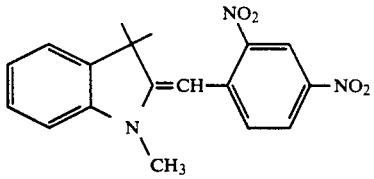

4

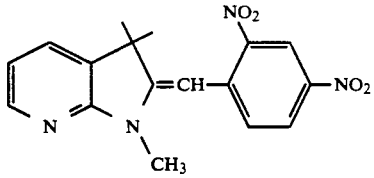

5

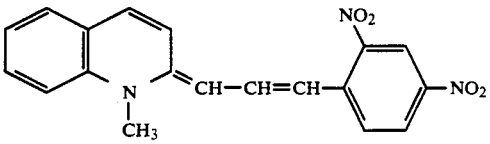

-continued

6

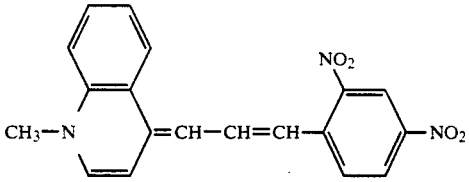

7

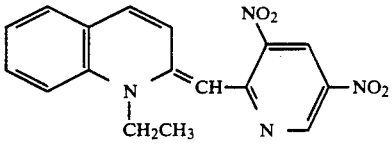

8

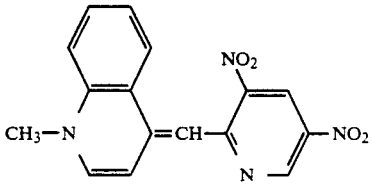

9

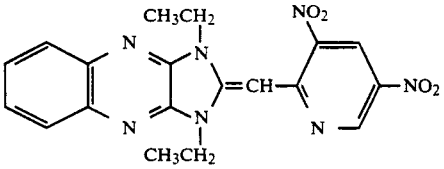

10

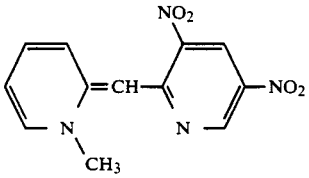

11

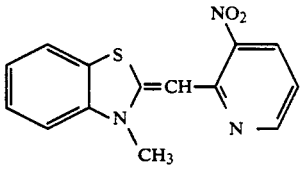

12

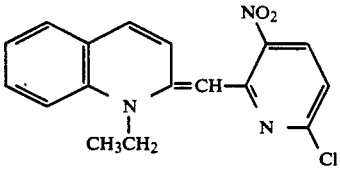

13

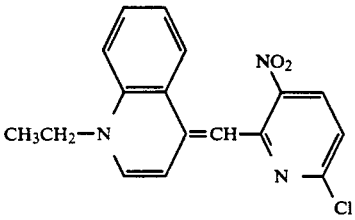

-continued

14 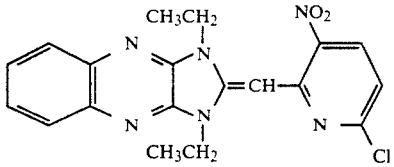

15 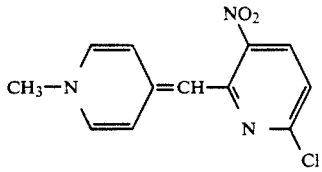

16 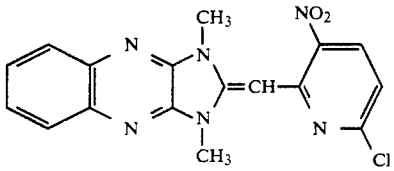

17 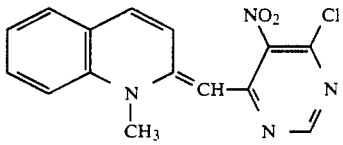

18 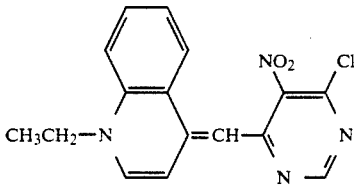

19 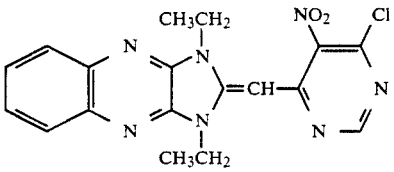

20 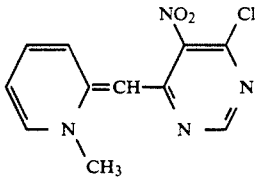

21 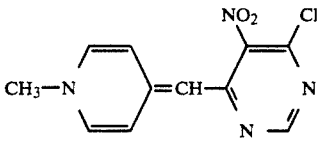

22 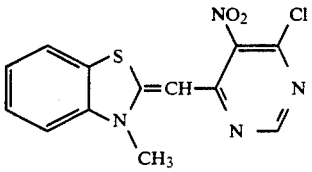

-continued

23 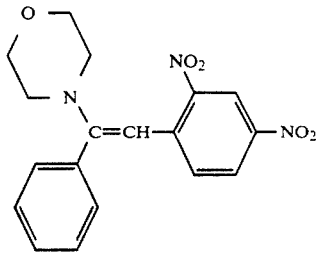

24 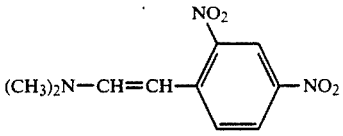

What is claimed is:

1. A negative-acting, photothermographic imageable layer comprising a binder, at least one leuco dye, nitrate ion, an ultraviolet radiation sensitive initiator, and a photobleachable spectral sensitizer for said initiator, said sensitizer bleaching at least 50% under the following conditions:

a film of polyethylene terephthalate (4 mil thickness) is coated with the sensitizer in question so as to create a colored film with an absorbance of from 0.1 to 0.6, whereupon said colored film is then exposed to light from a projection bulb having a color temperature of 33300° K., and the light intensity on the colored film is 0.46 $W/cm^2 \pm 0.05$ $W/cm^2$.

2. The imageable layer of claim 1 in which the ultraviolet radiation sensitive initiator is a diaryliodonium salt.

3. The imageable layer of claim 1 in which the ultraviolet light sensitive initiator is an organic compound having at least one photolyzable halogen atom.

4. The layer of claim 3 wherein said sensitizer is a photobleachable arylidene dye.

5. The imageable layer of claim 1 in which an organic acid is present in addition to the binder, leuco dye, nitrate ion, initiator, and photobleachable spectral sensitizer.

6. A process for forming an image comprising exposing the imageable layer of claim 1 to visible radiation within a range absorbed by said photobleachable spectral sensitizer, and heating the exposed layer to develop an image.

7. A process according to claim 6 in which the background photobleachable spectral sensitizer stain of the developed image is reduced comprising exposing the image developed after heating and exposer to a blanket irradiation of visible light.

8. A process according to claim 7 in which a developed image is fixed comprising exposing said developed image to a source of basic material after exposure to a blanket irradiation of visible light.

9. A negative-acting photothermographic element comprising a substrate having coated on at least one surface thereof a layer of claim 1.

10. The element of claim 9 wherein said initiator comprises a photosensitive diaryliodonium salt.

11. The element of claim 9 wherein said initiator comprises an organic compound having at least one photolyzable halogen atom.

12. A negative-acting, photothermographic imageable layer comprising a binder, at least one leuco dye, nitrate ion, an ultraviolet radiation sensitive initiator elected from the group consisting of an organic compound having at least one photolabile hydrogen and a diaryliodonium salt, and a photobleachable spectral sensitizer for said initiator, said sensitizer bleaching at least 50% under the following conditions:

a film of polyethylene terephthalate (4 mil thickness) is coated with the sensitizer in question so as to create a colored film with an absorbance of from 0.1 to 0.6, whereupon said colored film is then exposed to light from a projection bulb having a color temperature of 33300° K., and the light intensity on the colored film is 0.46 $W/cm^2 \pm 0.05$ $W/cm^2$, wherein the photobleachable spectral sensitizer is represented by the formula:

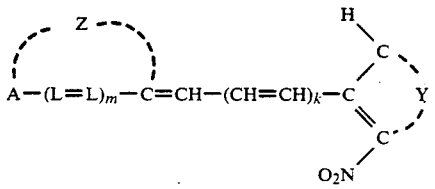

wherein k represents 0 or 1;

m represents 0 or 1;

each L represents a methine group, including substituted groups;

A represents an electron donating moiety, such as oxygen (—O—), sulfur (—S—), or

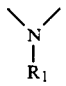

$R_1$ is selected from the group consisting of an alkyl group having from 1 to 18 carbon atoms; a sulfoalkyl group having from 1 to 4 carbon sulfatoalkyl group having 1 to 4 carbon atoms; an alkoxyalkyl group having from 2 to 5 carbon atoms; an acyloxyalkyl group having from 2 to 5 carbon atoms; an alkoxycarbonylalkyl group having 1 to 4 carbon atoms in both the alkoxy and alkyl moieties; a dialkylaminoalkylene group having 2 to 8 carbon atoms; a cycloaminoalkylene group having 4 to 6 atoms in the cycloamino moiety an 1 to 4 atoms in the alkyl moiety; an alkyneyl group having 2 to 4 carbon atoms; a substituted or unsubstituted aryl group having from 1 to 20 carbon atoms, further wherein the substituent is chosen from the group consisting of halogen, alkoxy having from 1 to 4 carbon atoms, alkyl having from 1 to 4 carbon atoms; or hydrogen; and Y represents the atoms necessary to complete an aryl ring which is o-nitro-substituted and preferably is also p-substituted with a nitro or other electron withdrawing group and which aryl ring can have other substituents attached to it and other carbocyclic rings fused to it; and Z represents the nonmetallic atoms necessary to complete a heterocyclic nucleus of the type used in cyanine dyes containing 5 or 6 atoms in the heterocyclic ring containing the electron-donating atom of the formula which ring can contain a second heteroatom such as oxygen, nitrogen, selenium, or sulfur, the heterocyclic nucleus being selected from the group consisting of thiazole nucleus including substituted and unsubstituted benzothiazole and naphthothiazole nuclei; an oxazole nucleus including substituted and unsubstituted benzoxazole and naphthoxazole nuclei; a selenazole nucleus including substituted or unsubstituted benzoselenazole and naphthoselenazole nuclei; a thiazoline nucleus; a 4-pyridine nucleus; a 3,3-dialkylindolenine nucleus; an imidazole nucleus; a quinoline nucleus; an imidazo[4,5-b]quinoline nucleus; a pyrylium nucleus; and a dithiolinium nucleus.

13. A negative-acting, photothermographic imageable layer comprising a binder, at least one leuco dye, nitrate ion, an ultraviolet radiation sensitive initiator elected from the group consisting of an organic compound having at least one photolabile hydrogen and a diaryliodonium salt, and a photobleachable spectral sensitizer for said initiator, said sensitizer bleaching at least 50% under the following conditions:

a film of polyethylene terephthalate (4 mil thickness) is coated with the sensitizer in question so as to create a colored film with an absorbance of from 0.1 to 0.6, whereupon said colored film is then exposed to light from a projection bulb having a color temperature of 33300° K., and the light intensity on the colored film is $0.46W/cm^2 \pm 0.05W/cm^2$, wherein the photobleachable spectral sensitizer is represented by the formula

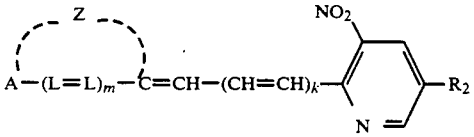

wherein each L represents a methine group, including substituted groups;

A represents an electron donating moiety, such as oxygen (—O—), sulfur (—S—), or

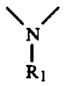

$R_1$ is selected from the group consisting of an alkyl group having from 1 to 18 carbon atoms; a sulfoalkyl group having from 1 to 4 carbon sulfatoalkyl group having 1 to 4 carbon atoms; an alkoxyalkyl group having from 2 to 5 carbon atoms; an acyloxyalkyl group having from 2 to 5 carbon atoms; an alkoxycarbonylakyl group having 1 to 4 carbon atoms in both the alkoxy and alkyl moieties; a dialkylaminoalkylene group having 2 to 8 carbon atoms; a cycloaminoalkylene group having 4 to 6 atoms in the cycloamino moiety an 1 to 4 atoms in the alkyl moiety; an alkyneyl group having 2 to 4 carbon atoms; a substituted or unsubstitued aryl group having from 1 to 20 carbon atoms, further wherein the substituent is chosen from the group consisting of halogen, alkoxy having from 1 to 4 carbon atoms, alkyl having from 1 to 4 carbon atoms; or hydrogen; and Y represents the atoms necessary to complete an aryl ring which is o-nitro-substituted and preferably is also p-substituted with a nitro or other electron withdrawing group and which aryl ring can have other substituents attached to it and other carbocyclic rings fused to it; and Z represents the nonmetallic atoms necessary to complete a heterocyclic nucleus of the type used in cyanine dyes containing 5 or 6 atoms in the heterocylic ring containing the electron-donating atom of the formula which ring can contain a second heteroatom selected from the group consisting of oxygen, nitrogen, selenium, or sulfur; and $R_2$ represents hydrogen, nitro, cyano, a carboalkoxy group of from 2 to 19 carbon atoms, or halogen.

14. A negative-acting, photothermographic imageable layer comprising a binder, at least one leuco dye, nitrate ion, an ultraviolet radiation sensitive initiator elected from the group consisting of an organic compound having at least one photolabile hydrogen and a diaryliodonium salt, and a photobleachable spectral sensitizer for said initiator, said sensitizer bleaching at least 50% under the following conditions:

a film of polyethylene terephthalate (4 mil thickness) is coated with the sensitizer in question so as to create a colored film with an absorbance of from 0.1 to 0.6, whereupon said colored film is then exposed to light from a projection bulb having a color temperature of 33300° K., and the light intensity on the colored film is $0.46W/cm^2 \pm 0.05W/cm^2$, wherein the photobleachable spectral sensitizer is represented by the formula

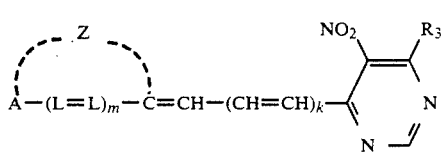

wherein $R_3$ represents halogen; and each L represents a methine group, including substituted groups;

a represents an electron donating moiety, such as oxygen (—O—), sulfur (—S—), or

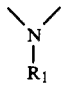

$R_1$ is selected from the group consisting of an alkyl group having from 1 to 18 carbon atoms; a sulfoalkyl group having 1 to 4 carbon atoms; an alkoxyalkyl group having 1 to 4 carbon atoms; an alkoxyalkyl group having from 2 to 5 carbon atoms; an acyloxyalkyl group having from 2 to 5 carbon atoms; an alkoxycarbonylalkyl group having 1 to 4 carbon atoms in both the alkoxy and alkyl moieties; a dialkylaminoalkylene group having 2 to 8 carbon atoms; a cycloaminoalkylene group having 4 to 6 atoms in the cycloamino moiety an 1 to 4 atoms in the alkyl moiety; an alkyneyl group having 2 to 4 carbon atoms; a substituted or unsubstitued aryl group having from 1 to 20 carbon atoms, further wherein the substituent is chosen from the group consisting of halogen, alkoxy having from 1 to 4 carbon atoms, alkyl having from 1 to 4 carbon atoms; or hydrogen; and Y represents the atoms necessary to complete an aryl ring which is o-nitro-substituted and may is also p-substituted with a nitro or other electron withdrawing group and which aryl ring can have other substituents attached to it and other carbocyclic rings fused to it; and Z represents the nonmetallic atoms necessary to complete a heterocyclic nucleus of the type used in cyanine dyes containing 5 or 6 atoms in the heterocylic ring containing the electron-donating atom of the formula which ring can contain a second heteroatom such as oxygen, nitrogen, selenium, or sulfur

15. A negative-acting, photothermographic imageable layer comprising a binder, at least one leuco dye, nitrate ion, an ultraviolet radiation sensitive initiator elected from the group consisting of an organic compound having at least one photolabile hydrogen and a diaryliodonium salt, and a photobleachable spectral sensitizer for said initiator, said sensitizer bleaching at least 50% under the following conditions:

a film of polyethylene terephthalate (4 mil thickness) is coated with the sensitizer in question so as to create a colored film with an absorbance of from 0.1 to 0.6, whereupon said colored film is then exposed to light from a projection bulb having a color temperature of 33300° K., and the light intensity on the colored film is $0.46W/cm^2 \pm 0.05W/cm^2$, wherein the photobleachable spectral sensitizer is represented by the formula

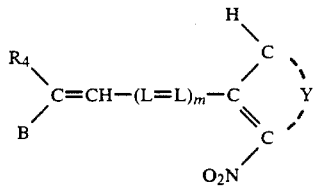

wherein each L represents a methine group, including substituted groups;

Y represents the atoms necessary to complete an aryl ring which is o-nitro-substituted and preferably is also p-substituted with a nitro or other electron withdrawing group and which aryl ring can have other substituents attached to it and other carbocyclic rings fused to it; and m is an integer from 0 to 5, inclusive; and $R_4$ is selected from the group consisting of hydrogen, alkyl having from 1 to 18 carbon atoms; aryl having from 1 to 20 carbon atoms; alkaryl having from 7 to 11 carbon atoms; aralkyl having from 7 to 11 carbon atoms; heteroaryl; alkoxyalkyl containing from 1 to 4 carbon atoms in each of the alkoxy and alkyl moieties; alkoxycarbonylalkyl containing from 1 to 4 carbon atoms in each of the alkoxy and alkyl moieties; or halogen; and B may be chosen from amino; alkylamino having from 1 to 6 carbon atoms; dialkylamino with each alkyl group individually having from 1 to 6 carbon atoms; cycloalkyamino having from 2 to 6 carbon atoms; morpholino; alkylmorpholino having from 4 to 18 carbon atoms; alkylpiperazino having from 5 to 18 carbon atoms; arylamino having from 6 to 10 carbon atoms; diarylamino with each aryl group individually being phenyl or substituted phenyl, and having from 6 to 18 carbon atoms.

16. A negative-acting photothermographic element comprising a substrate having coated on at least one surface thereof in reactive association in one or more layers of binder: 1) a leuco dye, 2) nitrate ion, 3) ultraviolet radiation sensitive initiator, and 4) a visible light spectral sensitizer for said initiator, wherein said sensitizer is a photobleachable arylidene dye.

17. A negative-acting, photothermographic imageable layer comprising a binder, at least one leuco dye, nitrate ion, an ultraviolet radiation sensitive initiator, and a photobleachable spectral sensitizer for said initiator, said sensitizer bleaching at least 25% under the following conditions:

a film of polyethylene terephthalate (4 mil thickness) is coated with the sensitizer in question so as to create a colored film with an absorbance of from 0.1 to 0.6, whereupon said colored film is then exposed to light from a projection bulb having a color temperature of 33300° K., and the light intensity on the colored film is $0.46W/cm^2 \pm 0.05W/cm^2$.

18. The imageable layer of claim 17 in which the ultraviolet radiation sensitive initiator is a diaryliodonium salt.

19. A negative-acting, photothermographic imageable layer comprising a binder, at least one leuco dye, nitrate ion, an ultraviolet radiation sensitive initiator elected from the group consisting of an organic compound having at least one photolabile hydrogen and a diaryliodonium salt, and a photoblechable spectral sensitizer for said initiator, said sensitizer bleaching at least 50% under the following conditions:

a film of polyethylene terephthalate (4 mil thickness) is coated with the sensitizer in question so as to create a colored film with an absorbance of from 0.1 to 0.6, whereupon said colored film is then exposed to light from a projection bulb having a color temperature of 33300° K., and the light intensity on the colored film is $0.46W/cm^2 \pm 0.05W/cm^2$, wherein said sensitizer is a photobleachable arylidene dye.

20. A negative-acting, photothermographic imageable layer comprising a binder, at least one leuco dye, nitrate ion, an ultraviolet radiation sensitive initiator elected from the group consisting of an organic compound having at least one photolabile hydrogen and a diaryliodonium salt, and a photobleachable spectral sensitizer for said initiator, said sensitizer bleaching at least 50% under the following conditions:

a film of polyethylene terephthalate (4 mil thickness) is coated with the sensitizer in question so as to create a colored film with an absorbance of from 0.1 to 0.6, whereupon said colored film is then exposed to light from a projection bulb having a color temperature of 33300° K., and the light intensity on the colored film is $0.46W/cm^2 \pm 0.05W/cm^2$, in which the ultraviolet radiation sensitive initiator is a diaryliodonium salt, and in which an organic acid is present in addition to the binder, leuco dye, nitrate ion, initiator, and sensitizer, and the photobleachable spectral sensitizer is represented by the formula

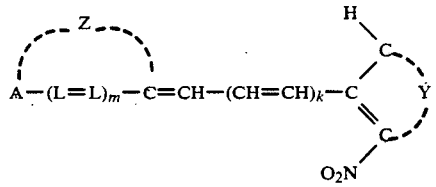

wherein k represents 0 or 1;

m represents 0 or 1;

each L represents a methine group;

A represents an electron donating moiety, $R_1$ is selected from the group consisting of an alkyl group having from 1 to 18 carbon atoms; a sulfoalkyl group having from 1 to 4 carbon sulfatoalkyl group having 1 to 4 carbon atoms; an alkoxyalkyl group having from 2 to 5 carbon atoms; an acyloxyalkyl group having from 2 to 5 carbon atoms; an alkoxycarbonylalkyl group having 1 to 4 carbon atoms in both the alkoxy and alkyl moieties; a dialkylaminoalkylene group having 2 to 8 carbon atoms; a cycloaminoalkylene group having 4 to 6 atoms in the cycloamino moiety an 1 to 4 atoms in the alkyl moiety; an alkyneyl group having 2 to 4 carbon atoms; a substituted or unsubstituted aryl group having from 1 to 20 carbon atoms, further wherein the substituent is chosen from the group consisting of halogen, alkoxy having from 1 to 4 carbon atoms, alkyl having from 1 to 4 carbon atoms; or hydrogen; and Y represents the atoms necessary to complete an aryl ring which is o-nitro-substituted and preferably is also p-substituted with a nitro or other electron withdrawing group and which aryl ring can have other substituents attached to it and other carbocyclic rings fused to it; and Z represents the nonmetallic atoms necessary to complete a heterocyclic nucleus of the type used in cyanine dyes containing 5 or 6 atoms in the heterocylic ring containing the electron-donating atom of the formula which ring can contain a second heteroatom such as oxygen, nitrogen, selenium, or sulfur, the heterocyclic nucleus being selected from the group consisting of thiazole nucleus including substituted and unsubstituted benzothiazole and naphthothiazole nuclei; an oxazole nucleus including substituted and unsubstituted benzoxazole and naphthoxazole nuclei; a selenazole nucleus including substituted or unsubstituted benzoselenazole and naphthoselenazole nuclei; a thiazoline nucleus; a 4-pyridine nucleus; a 3,3-dialkylindolenine nucleus; an imidazole nucleus; a quinoline nucleus; an imidazo quinoline nucleus; a pyrylium nucleus; and a dithiolinium nucleus.

* * * * *

UNITED STATES PATENT AND TRADEMARK OFFICE

CERTIFICATE OF CORRECTION

PATENT NO. : 5,153,104

DATED : October 6, 1992

INVENTOR(S) : Rossman et al.

It is certified that error appears in the above-identified patent and that said Letters Patent is hereby corrected as shown below:

| | |
|---|---|
| Title Page, [22] | "Sep. 3, 1992" should be -- Sep. 3, 1991 -- |
| Col. 21, line 3 | "has" should be -- had -- |
| Col. 24, line 54 | "exposer" should be -- exposure -- |

Signed and Sealed this

Eighth Day of February, 1994

Bruce Lehman

*Attest:*

BRUCE LEHMAN

*Attesting Officer*

*Commissioner of Patents and Trademarks*